US006828924B2

(12) United States Patent
Gustavsson et al.

(10) Patent No.: US 6,828,924 B2
(45) Date of Patent: Dec. 7, 2004

(54) INTEGRATED VEHICLE COMMUNICATIONS DISPLAY

(75) Inventors: Tommy Gustavsson, Greensboro, NC (US); Riley Muse, Chapel Hill, NC (US); Michael Blackard, Madison, NC (US); Jon Quigley, Kernersville, NC (US); John Bate, Oak Ridge, NC (US); Brian Kidd, Greensboro, NC (US)

(73) Assignee: Volvo Trucks North America, Inc., Greensboro, NC (US)

( * ) Notice: Subject to any disclaimer, the term of this patent is extended or adjusted under 35 U.S.C. 154(b) by 0 days.

(21) Appl. No.: 10/114,626

(22) Filed: Apr. 2, 2002

(65) Prior Publication Data

US 2003/0085819 A1 May 8, 2003

Related U.S. Application Data

(60) Provisional application No. 60/332,865, filed on Nov. 6, 2001.

(51) Int. Cl.[7] ..... G08G 1/123

(52) U.S. Cl. ..... 340/995.1; 340/990; 340/905; 340/539.13

(58) Field of Search ..... 340/425.5, 435, 340/436, 438, 903, 905, 988, 439, 539.13, 990, 995.1, 996; 701/1, 2, 21, 36, 49, 209, 213, 27, 35; 702/3; 343/715, 722

(56) References Cited

U.S. PATENT DOCUMENTS

| | | | | | |
|---|---|---|---|---|---|
| 4,804,937 | A | | 2/1989 | Barbiaux et al. | 340/459 |
| 4,809,177 | A | | 2/1989 | Windle et al. | 701/1 |
| 4,939,652 | A | | 7/1990 | Steiner | 340/438 |
| 5,303,163 | A | | 4/1994 | Ebaugh et al. | 340/439 |
| 5,544,225 | A | | 8/1996 | Kennedy, III et al. | 340/431 |
| 5,565,874 | A | * | 10/1996 | Rode | 340/990 |
| 5,684,860 | A | | 11/1997 | Milani et al. | 455/412 |
| 5,732,074 | A | | 3/1998 | Spaur et al. | 370/313 |
| 5,734,352 | A | * | 3/1998 | Seward et al. | 343/722 |
| 5,757,359 | A | * | 5/1998 | Morimoto et al. | 345/156 |
| 5,808,907 | A | | 9/1998 | Shetty et al. | 340/989 |
| 5,867,093 | A | * | 2/1999 | Dodd et al. | 340/438 |
| 5,890,080 | A | | 3/1999 | Coverdill et al. | 701/29 |
| 5,894,506 | A | | 4/1999 | Pinter | 379/88.23 |
| 5,917,408 | A | | 6/1999 | Cardillo et al. | 340/439 |
| 5,957,986 | A | | 9/1999 | Coverdill | 340/438 |
| 5,999,882 | A | * | 12/1999 | Simpson et al. | 702/3 |
| 6,028,537 | A | | 2/2000 | Suman et al. | 340/988 |
| 6,032,089 | A | | 2/2000 | Buckley | 701/36 |
| 6,073,007 | A | | 6/2000 | Doyle | 455/412 |
| 6,075,467 | A | * | 6/2000 | Ninagawa | 340/995 |
| 6,256,558 | B1 | * | 7/2001 | Sugiura et al. | 701/1 |
| 6,366,848 | B1 | | 4/2002 | Gustavsson | 340/439 |
| 6,407,663 | B1 | * | 6/2002 | Huggett | 340/461 |
| 6,611,755 | B1 | * | 8/2003 | Coffee et al. | 340/438 |

OTHER PUBLICATIONS

Volvo Trucks North America, Inc.'s Owners' Manual, pp. 66, 67, 91, 106–110, 144, 145, 154–157, 160 and 161, date unkonwn.

* cited by examiner

*Primary Examiner*—Van T. Trieu
(74) *Attorney, Agent, or Firm*—Watts Hoffmann Co.

(57) ABSTRACT

A communications system for use in a vehicle that allows the user of the communications system to safely communicate from inside the vehicle. The communications system includes a memory for storing messages that will be transmitted by the driver to a receiving party, a sensor for sensing movement of the truck, a display unit coupled to the memory and the sensor for selectively displaying stored messages, a selector for selecting at least one stored message to be communicated to the receiving party, and a transmitter for transmitting the one or more stored messages. The display unit selectively displays the stored messages based on whether or not the vehicle is stopped preventing the operator from being distracted while driving.

51 Claims, 10 Drawing Sheets

INTEGRATED VEHICLE COMMUNICATIONS DISPLAY

This application claims benefit of Provisional application Ser. No. 60/332,865 filed Nov. 6, 2001.

TECHNICAL FIELD

The present invention concerns mobile communication, and more particularly, a vehicle communications system that includes a display unit integrated into the vehicle instrument cluster and provides a convenient interface that allows the driver to easily and safely operate the communications system.

BACKGROUND OF THE INVENTION

Wireless communications systems on highway tractors or heavy duty trucks are becoming commonplace. The communications systems allow drivers to maintain contact with fleet management for the purpose of providing updates and requesting instructions. While cellular telephones may be used to maintain communication with fleet management, they may entail relatively large roaming fees. In addition, cell phone service does not cover all the areas that highway tractors travel through. In particular, cell phone coverage is sporadic in rural areas in which highway tractors travel the most. Generally, trucks try to stay away from the heavy traffic areas of major metropolitan areas. Cell phone coverage is presently focused on areas surrounding large cities.

Many highway tractors and heavy duty trucks have incorporated the use of wireless communications systems to send textual messages from the driver to the fleet. These systems may be separate communication units that include a keyboard and text display or monitor. It is known in the prior art to install a palmtop type computer in a vehicle to provide, among other things, Internet access and cellular phone control. Prior art palmtop systems are separate from the vehicle instrument panel and include a keyboard. Another prior art communications system is a messaging system that includes a separate mobile communications terminal. The mobile communications terminal allows a driver to send and receive free form messages in the form of satellite communications, cell phone communications, or e mail. The messages are tagged with a designation regarding whether the message is personal or business related so that the driver may be billed for personal messages. The system involves a separate communication unit and the use of free form text to compose messages. Some vehicle communication and remote control systems that provide a means of communication via RF signals.

While these systems provide adequate communication between the driver and fleet management, the keyboard consumes a significant amount of cab space. In addition, cellular phones and prior art wireless communications systems for highway tractors can be operated while the drive is driving the truck. When a driver is talking on a cellular phone or using a prior art wireless communications system and driving at the same time, the driver may become distracted, increasing the likelihood that he will be involved in an accident. Prior art satellite communication units that employ a keyboard are especially dangerous, since the driver must take his hands off the wheel to type on the keyboard.

What is needed is a vehicle communications system that does not take up additional space in the vehicle's cab and is easy and safe for the driver of the vehicle to operate, and does not distract the driver while the vehicle is moving.

DISCLOSURE OF THE INVENTION

The present invention concerns a communications system for use in a truck. The communications system includes a memory, a motion and/or location sensor, a display unit, a selector, and a transmitter. The communications system is used to safely send and receive messages in a heavy duty truck or a highway tractor. The memory stores messages for transmission by the driver of the truck to a receiving party. The sensor senses movement of the truck. The display unit is coupled to the memory and the sensor. The display unit displays stored messages when the truck is stopped. The selector is used to select one or more of stored messages that are to be transmitted to the receiving party. The transmitter transmits the one or more selected messages to the receiving party.

In one embodiment, the communications system is adapted to send messages to a receiving party and to receive messages from a sending party. One configuration of the communications system includes a text display unit that is integrated into an instrument panel of the truck. The instrument panel displays the status of a plurality of vehicle operating parameters. The memory stores a plurality of messages, which include incoming messages from the sending party and predetermined messages to be sent to a receiving party. The messages stored in memory are selectively displayed on a text display unit. A global positioning system or a sensor coupled to the transmission or engine of the truck senses the movement of the truck. The text display unit is coupled to the memory and to the global positioning system or the sensor that is coupled to the engine or the transmission of the truck. The display unit displays the predetermined messages only when the truck is stopped or moving at a very slow speed. The display unit displays priority incoming messages regardless of whether or not the truck is moving. The display unit displays non-priority incoming messages only when the truck is stopped.

In one embodiment, the selector is a lever that extends form the steering column of the truck. The lever includes a toggle switch which is moved up and down to highlight one of the predetermined messages when the truck is stopped. A highlighted predetermined message can be selected by pushing a button on the lever. Operation of the lever also allows the driver to selectively view priority incoming messages regardless of movement of the truck. Movement of the toggle switch on the lever allows the driver to highlight a response to the priority incoming message regardless of movement of the truck. The response is selected by pushing a enter button on the lever. The control lever allows the driver to highlight and select any type of messages only when the truck is stopped.

Movement of the toggle switch allows the driver to highlight alpha numeric characters. An alpha numeric character may be selected by pressing the enter button on the lever allowing free text messages to be entered when the truck is stopped. A satellite electronic communication unit is coupled to the display for transmitting and receiving messages. A CB antenna or radio antenna is coupled to the satellite electronic communications unit for transmitting and receiving messages to and from a satellite.

One embodiment of the communications system allows free text messages to be sent by the driver of the truck, predetermined stored messages to be communicated by the driver of the truck, and messages from a sending party to be received. The method of sending free text messages by operating a communications system of the present invention includes monitoring the speed of the truck. The driver is prevented from entering free text messages when the truck is moving. Free text messages are entered by operating a toggle switch and button on the lever that extends from the steering column of the truck when the truck is stopped. The free text messages are typed onto the display unit that is integral to the vehicle instrument panel when the vehicle is stopped by manipulating the toggle switch and the button.

The free text message is then transmitted to a receiving party. In one embodiment, the free text messages is transmitted via satellite. In another embodiment, the free text message is transmitted via terrestrial towers. In the third embodiment, the free text message is transmitted via cellular phones.

A method of transmitting predetermined text messages from inside the cab of a truck includes monitoring movement of the truck. Predetermined text messages are stored for transmission by a driver to a receiving party. The predetermined messages are prevented from being displayed when the truck is moving. The text messages are displayed on the display unit that is integral to the vehicle instrument panel when the vehicle is stopped. One of the text messages is highlighted by operating a toggle switch on the lever that extends from the steering column of the truck when the truck is stopped. The message is selected by pressing a return button on the lever. The text message is then transmitted to the receiving party.

The communications system receives incoming messages and allows responses to be selected and transmitted. Motion of the truck is monitored. Messages that are received from a sending party are stored in the memory. The received messages are prevented from being displayed when the truck is moving. The received messages are displayed on the display unit in the vehicle instrument panel when the vehicle is stopped. A predetermined response may be selected by operating a lever that extends from a steering column of the truck when the truck is stopped. The response is then sent to the receiving party.

One method of communicating from inside the cab of the truck includes monitoring the truck engine to determine if the truck is running. In one variation of this embodiment, signals from a J1587 databus are analyzed to determine engine speed. Motion of the truck is monitored with a global positioning system. High and low priority messages received from the sending party are stored by the communications system. The low priority messages are prevented from being displayed while the truck is moving. The high priority messages are displayed on the display unit regardless of whether the truck is moving. A predefined high priority response to the high priority message is highlighted by operating a toggle switch on a lever that extends from the steering column. The message is selected by pressing a return button on the lever. The predefined response to the high priority message is then transmitted to a receiving party. The low priority messages are only displayed when the truck is stopped. While the truck is stopped, a low priority response to the low priority message is highlighted by operating the toggle switch on the lever. The response to the low priority message is selected by pressing the enter button the lever. The low priority response is then transmitted to the receiving party. The communications system stores predetermined text messages for transmission by a driver to a receiving party. The predetermined messages are prevented from being displayed when the truck is moving. Once the truck is stopped, the predetermined messages are selectively displayed on the display unit. The user highlights one of the predetermined messages by operating a toggle switch on the lever when the truck is stopped. The enter button on the lever is selected to select the message. The predetermined message is then transmitted to a receiving party via satellite.

In one embodiment, free text messages are entered by scrolling through alpha-numeric characters by selectively pressing the toggle switch and selecting characters by pressing the lever and are transmitted to a receiving party.

One embodiment of the communications system is used to contact a service center when a vehicle requires roadside assistance. In this embodiment, the communications system includes a memory, a satellite communication unit, a worldwide web server, and a roadside assistance button in the cab of the truck. The memory stores a roadside assistance message that will be transmitted by a driver to the service center when the roadside assistance button is pushed. The satellite communication unit is in communication with the memory. The worldwide web server is in communication with the satellite communication unit and the service center. The roadside assistance button is coupled to the satellite communication unit. When the roadside assistance button is pushed, the satellite communication unit sends the roadside assistance signal to the satellite, which in turn sends a signal to the worldwide web server that is in communication with the service center.

In one embodiment of the communications system, a global positioning system is included that locates the truck and transmits the coordinates of the truck to the service center. In this embodiment, fault codes may be sent from the truck to the service center.

The method of communicating a roadside assistance message includes storing a roadside assistance message that will be transmitted to a service center. The roadside assistance button is then pushed to communicate the roadside assistance message to the satellite communication unit. The satellite communication unit transmits the roadside assistance message to the satellite. The satellite transmits the roadside assistance message to a worldwide web server, where the roadside assistance message may be accessed at the service center.

In one embodiment of the invention, the roadside assistance signal is also transmitted to a truck company dispatcher. The roadside assistance signal alerts the truck company of the condition of the truck.

Additional features of the invention will become apparent and a fuller understanding obtained by reading the following detailed description in connection with the accompanying drawings.

BEST MODE FOR CARRYING OUT THE INVENTION

Figure 2:
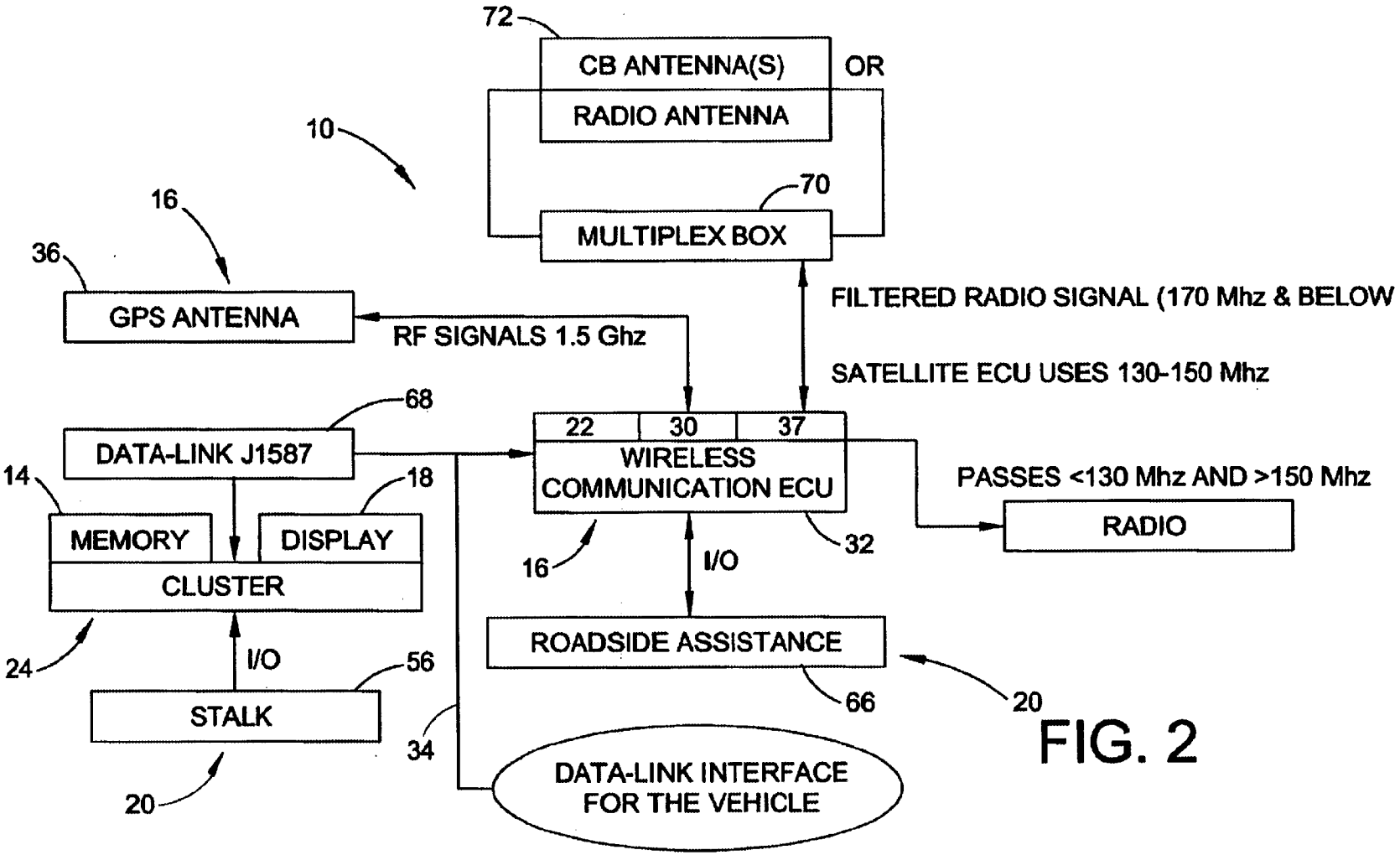
FIG. 2 is a schematic representation of an integrated vehicle communications system.
Figure 3:
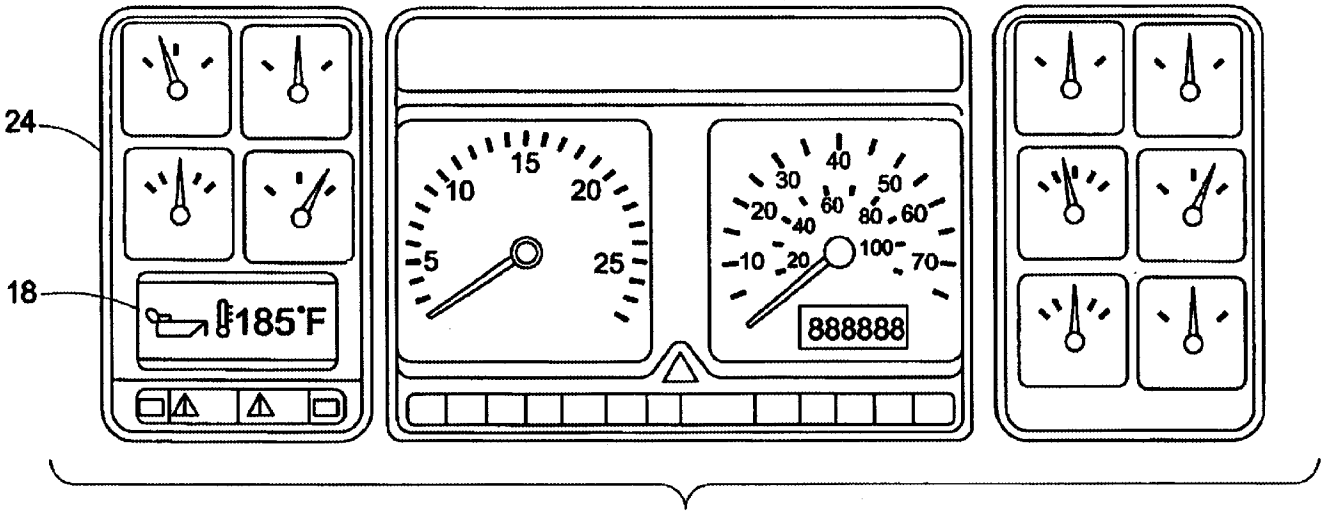
FIG. 3 is a front plan view of a vehicle instrument panel.

The present invention is directed to an integrated communications system 10 for use in a vehicle 12, such as a highway tractor or heavy duty truck. Referring to FIG. 2, the communications system includes a memory 14, a sensor 16 (such as a GPS sensor), a display unit 18, one or more selectors 20 and a transmitter 22. In the exemplary embodiment, the memory 14 and the display unit 18 are included in the cluster 24 that is integrated into an instrument panel 26 of the truck 12 (FIG. 3). In an alternate embodiment, memory is included in a satellite ECU. One acceptable cluster is model #20410723, produced by Berifors. In the illustrated embodiment, the CB antenna, or radio antenna, are coupled to the ECU by a multiplex box 70. In an alternative embodiment, the CB antenna or radio antenna is coupled directly to the ECU.

The memory stores the menu driven program 28 (FIG. 4) that is displayed on the display unit 18. The memory also stores predetermined messages 19 (FIG. 5) that may be sent out by the operator of the communications system 10, incoming messages that are received by the communications unit 10, responses to high priority incoming messages and a roadside assistance message. In the exemplary embodiment, the operating system for the menu driven display 28 is built into the cluster. The menu driven display 28 is programmed in a C programming language. The details of programming the display 18 to display the menu driven program 28 should be readily apparent to those skilled in the art.

Referring to FIG. 2, the sensor 16 senses movement of the truck 12, and in the exemplary embodiment senses the position of the truck 12. In the exemplary embodiment, two sensors are included in the integrated communication system 10. A first sensor 30 is included in the satellite electronic communication unit (ECU) 32. The first sensor 30 is coupled to a vehicle databus 34 which is in communication with the engine, transmission, ABS and other vehicle components. The databus monitors the main components in the truck to allow determination of a component of the truck is not functioning properly. In the exemplary embodiment, the databus monitors the ECU, the transmission, the engine, EBS, the vehicle ECUn (multiplexer) and/or instrumentation. The databus 34 is also monitored to determine whether or not the vehicle is running. The first sensor 30 monitors the databus 34 to determine engine RPM, vehicle speed and transmission gear ratios. The information collected from the databus 34 by the first sensor 30 is used to determine whether the vehicle engine is running and whether the vehicle is moving.

The second sensor is a global positioning system (GPS) antenna 36 of a GPS 37 that is coupled to or included in the satellite electronic communications unit 32. The input to the GPS antenna 36 can be used to determine whether or not the vehicle is moving, as well as the position of the vehicle. By monitoring whether or not the vehicle is running, the communications system 10 determines whether or not the system 10 will allow messages to be sent and received.

The communication system 10 need not have both a GPS and a databus sensor. Either a GPS antenna 36 or input from the databus 34 could serve as the sensor 16 by itself. When the first sensor 30 is used to collect information from the databus 34, the engine is monitored to determine if the vehicle is running and the transmission is monitored to determine if the vehicle is moving. When the GPS 37 is used by alone, movement of the vehicle is monitored with the global positioning system and an indication of whether the vehicle is running or not is obtained by monitoring another parameter of the vehicle available on the databus, such as engine RPM.

Figure 3A:
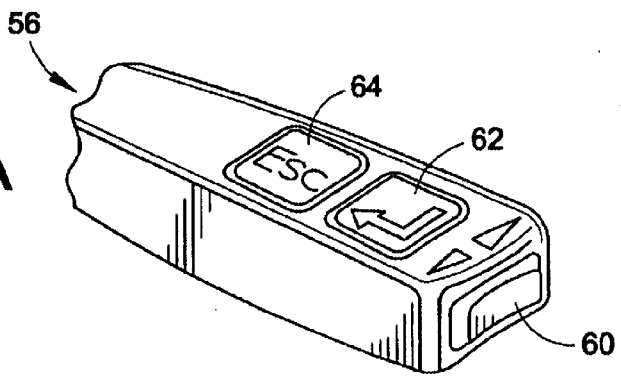
FIG. 3A is a perspective view of a lever that extends from the steering column of a vehicle.
Figure 3B:
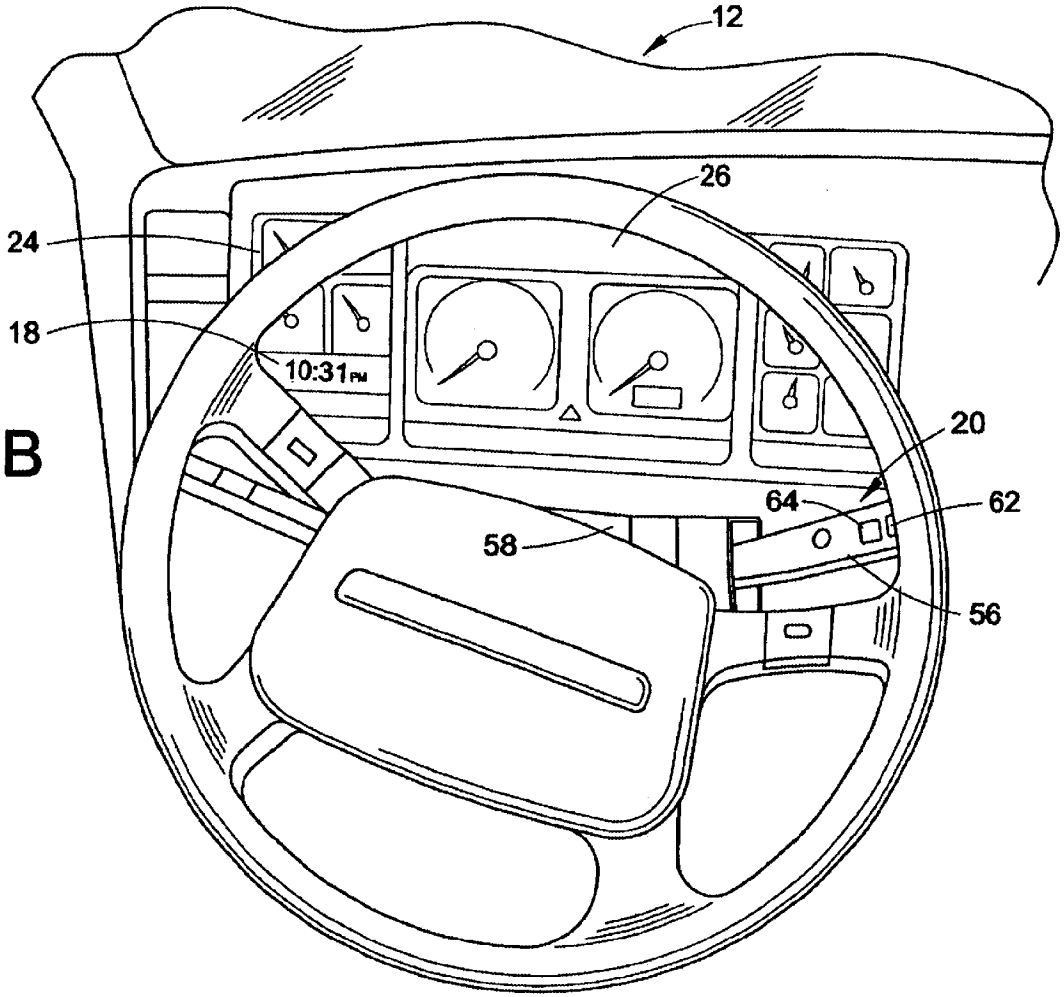
FIG. 3B is a perspective view of a vehicle steering column.

FIGS. 3, 3A and 3B illustrate an instrument panel 26 included in the vehicle 12. The cluster 24 is integrated into the instrument panel 26. The display unit 18 is included in the cluster 24. The display unit 18 is coupled to the memory 14 that is also contained in the cluster 24 in the exemplary embodiment. The display unit 18 is also in communication with the GPS antenna 36, the satellite electronic communications unit 32 and the selectors 20.

Figure 4:
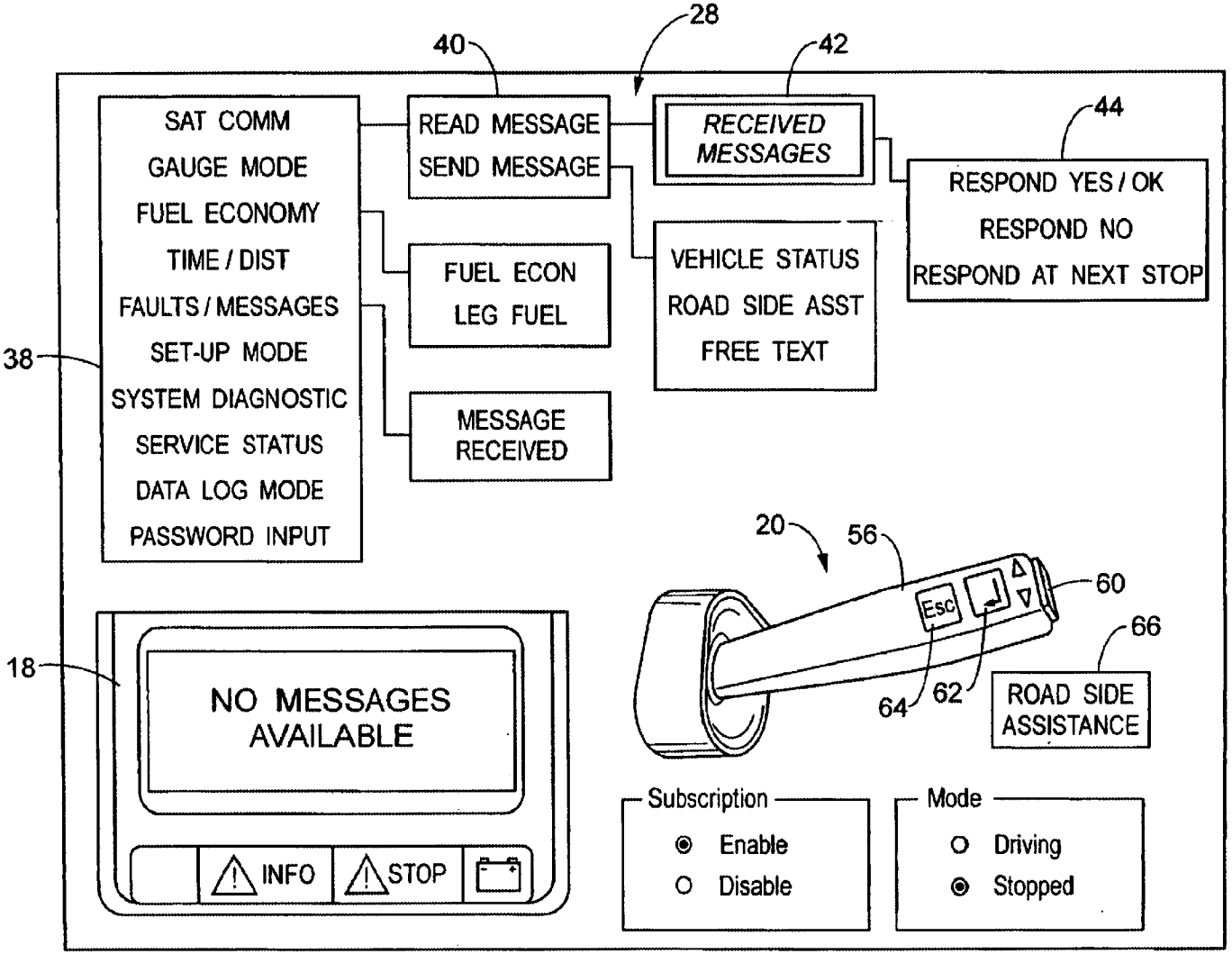
FIG. 4 is a depiction of a display showing a representative user interface for viewing sent and received messages, as well as viewing other vehicle parameters.

Referring to FIG. 4, the display unit program 28 is menu driven, allowing a variety of messages and vehicle parameters to be displayed on a relatively small display unit 18. The illustrated menu driven display 28 includes a primary menu 38 with satellite communications, gauge mode, fuel economy, time and distance, false and messages, set up mode, system diagnostic, service status, dialog mode, and password input options. Selecting the satellite communications option allows the driver to send and receive messages via satellite. Selecting the gauge mode option allows the driver to access various gauges of the truck. Selecting the fuel economy option allows the driver to display the fuel economy of the truck for a trip or for current operating conditions. Selecting the time/distance option allows the driver to view the current time and view the distance traveled for the current trip. The faults/messages option allows the driver to view messages and detected faults of various vehicle components. Selecting set-up mode allows the driver to set-up the display. Selecting system diagnostic causes the display to perform a diagnostic test on the cluster. Selecting service status causes the next required service to be displayed. In one embodiment, selecting the data log mode option enables the user to view the logged data in the vehicle. Selecting the password input option allows the driver to enter his or her password.

Referring to FIG. 4, the subscription enable or disable status may not be shown on the display. The subscription enable or disable status is initially set up and may be changed by access through the world wide web. Similarly, the driving mode, driving/stopped, is not typically shown on the display. In the exemplary embodiment, the driving/stopped mode is set by one or more sensors that detect motion of the truck.

When the satellite communications option is selected from the primary menu 38, a satellite communications menu 40 appears on the display. The satellite communications menu 40 gives the operator the option to read messages or send messages. When read message option is selected from the communications menu 40 a read message menu 42 appears. In one embodiment, if the truck is moving a response may be sent to a high priority message. In this embodiment, a response may only be sent to a low priority message if the truck is stopped. The read message menu 42, displays whether or not messages have been received. If a message has been received, a response menu 44 can be opened which allows the operator of the vehicle to select a response to the received message. In the exemplary embodiment, the predefined responses are "YES/OK", "NO", and "RESPOND AT NEXT STOP."

In the exemplary embodiment, messages which are received by the integrated communications system 10 are coded as priority messages and non-priority messages. An example of a priority message is "Urgent, please call home as soon as possible." An example of a non-priority message is "Please call home when you have time." The operator of the vehicle is prevented from viewing non-priority messages while the vehicle is moving by the communication ECU. The operator of the vehicle can view priority messages while the vehicle is moving, but can only send the very limited responses of "YES/OK", "NO" and "RESPOND AT NEXT STOP" while the vehicle is moving.

Figure 5:
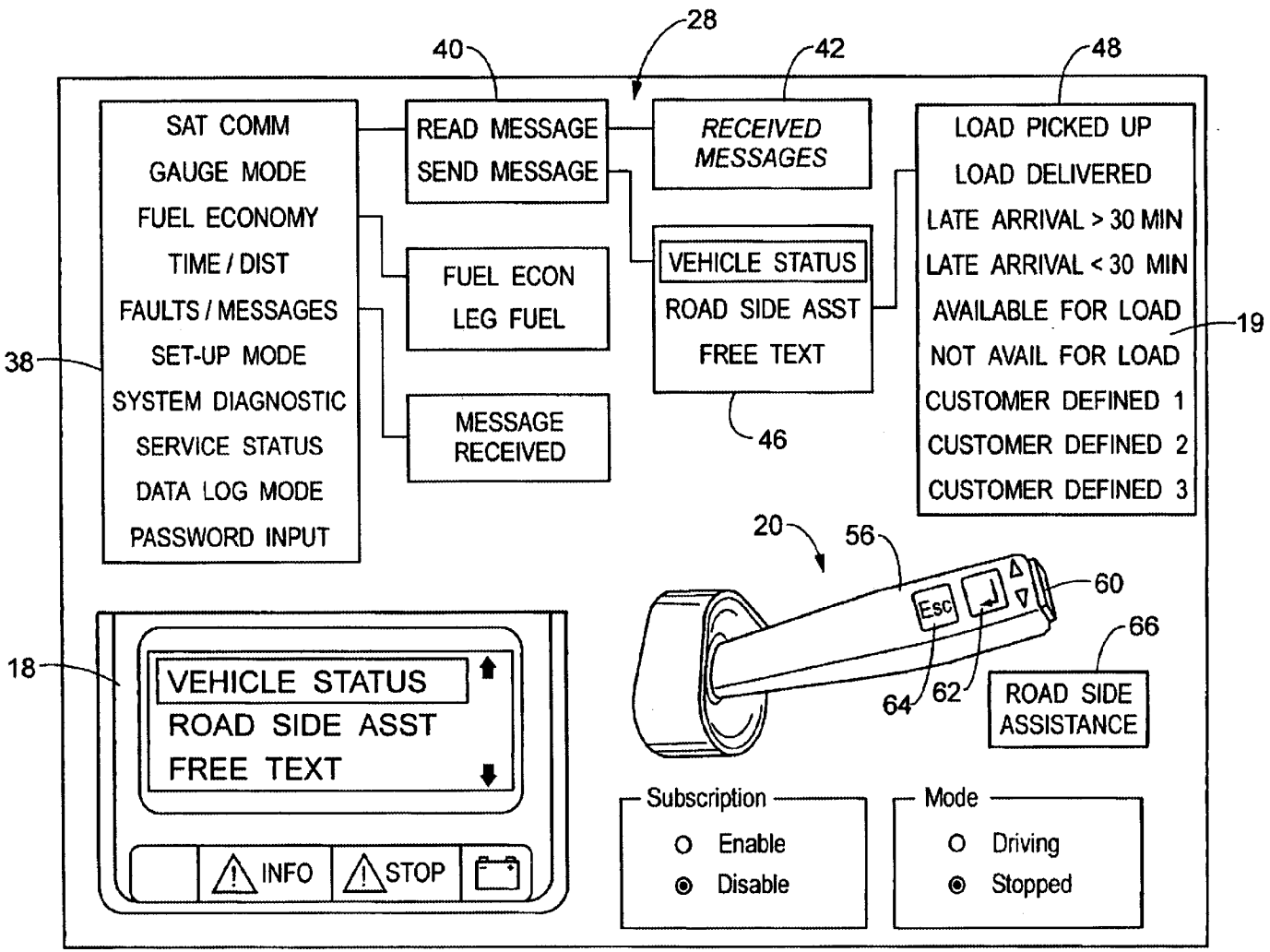
FIG. 5 is a depiction of a display showing a representative user interface for viewing sent and received messages, as well as viewing other vehicle parameters.
Figure 6:
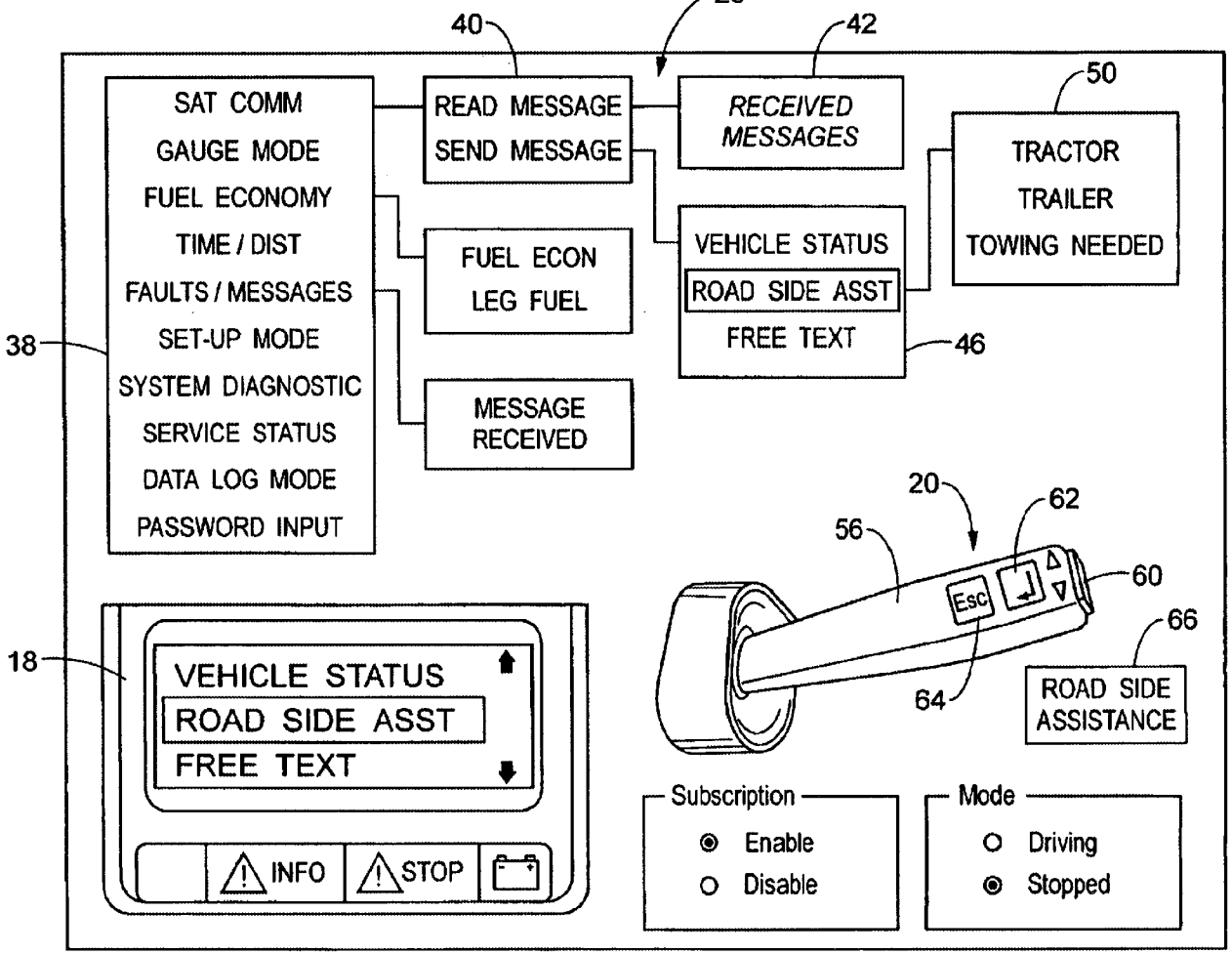
FIG. 6 is a depiction of a display showing a representative user interface for viewing sent and received messages, as well as viewing other vehicle parameters.
Figure 7:
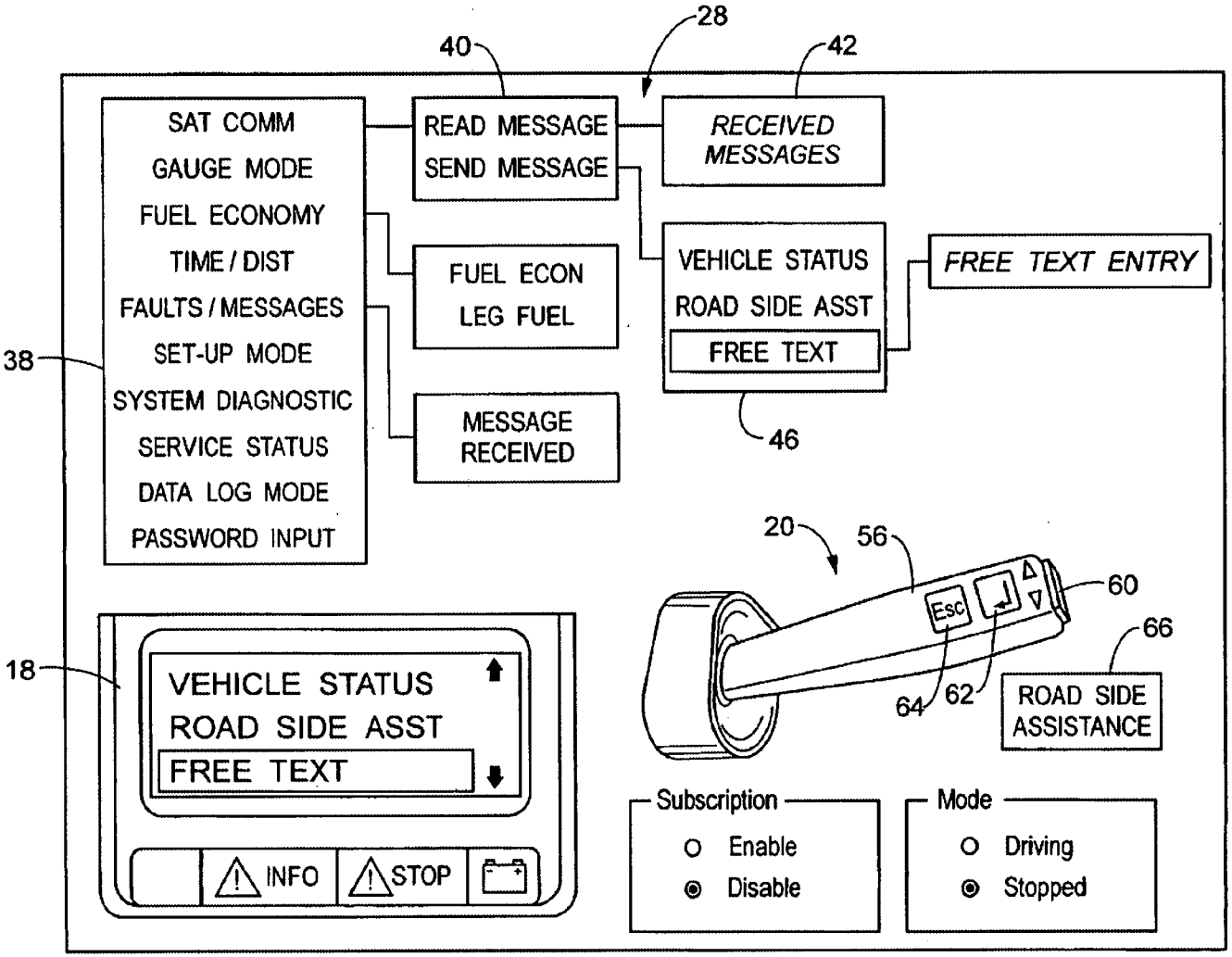
FIG. 7 is a depiction of a display showing a representative user interface for viewing sent and received messages, as well as viewing other vehicle parameters.

Referring to FIGS. 5, 6 and 7, when the send message option is selected from the satellite communications menu 40 a message type menu 46 appears on the display unit 18. In the exemplary embodiment, the menu driven software 28 only allows the driver to enter the message type menu 46 when the vehicle is stopped, thereby preventing the operator from selecting or inputting messages while the vehicle is moving. In the illustrated embodiment, the message type menu 46 includes vehicle status, roadside assistance, and free text options. When the vehicle status option is selected, the vehicle status submenu 48 appears on the display unit 18 (FIG. 5). The vehicle status submenu 48 allows the operator of the vehicle to select a predefined message that is associated with the vehicle status. In the illustrated embodiment, the messages that may be selected from the vehicle status submenu 48 are load picked-up, load delivered, late arrival greater than 30 minutes, late arrival less than 30 minutes, available for load, not available for load and customer defined messages.

Figure 8:
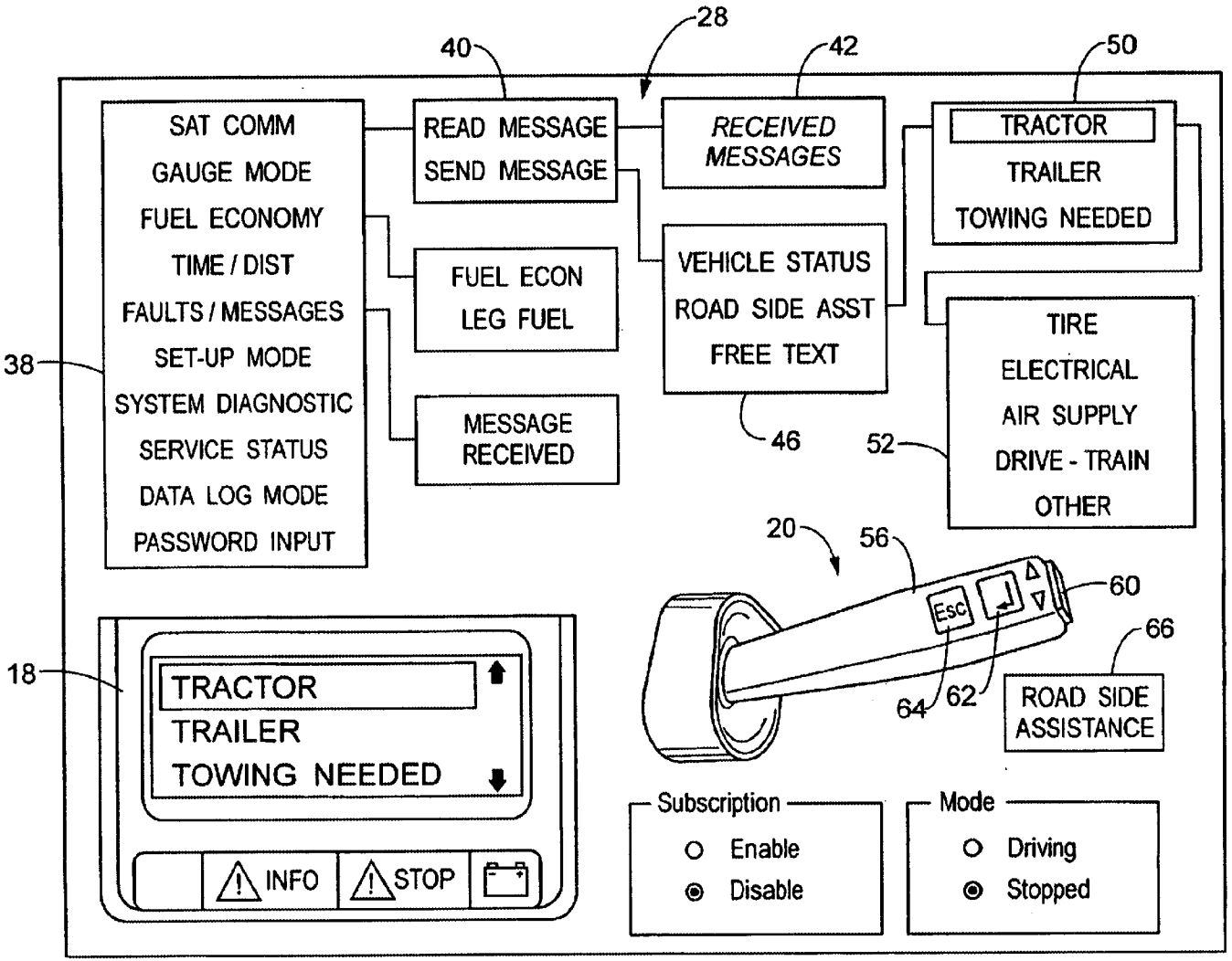
FIG. 8 is a depiction of a display showing a representative user interface for viewing sent and received messages, as well as viewing other vehicle parameters; and, FIG. 9 is a depiction of a display showing a representative user interface for viewing sent and received messages, as well as viewing other vehicle parameters.
Figure 9:
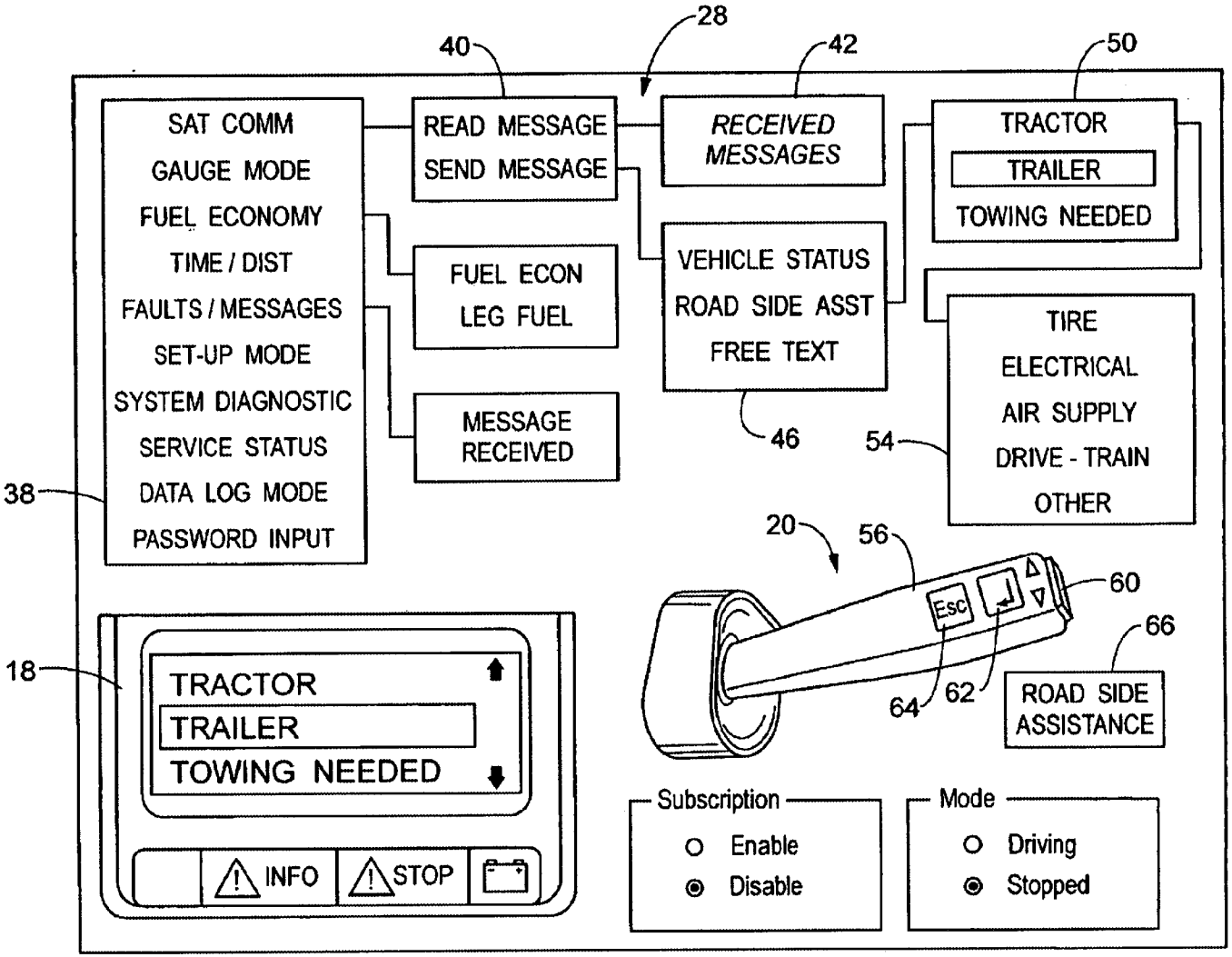

Referring to FIGS. 6, 8 and 9, when the roadside assistance option is selected from the message type menu 46, a roadside assistance submenu 50 appears on the display unit 18. The roadside assistance submenu 50 includes tractor, trailer and towing needed options. When the tractor option is selected, a tractor submenu 52 appears on the display unit 18. The tractor submenu 52 includes tire, electrical, air supply, drive train and other options. When one of the options of the tractor submenu 52 is selected, a predetermined message corresponding to that selection is selected and transmitted. Fault codes are also transmitted when roadside assistance messages are transmitted.

When the trailer option of the roadside assistance submenu 50 is selected, a trailer submenu 54 appears on the display unit 18. The trailer submenu 54 also includes tire, electrical, air supply, drive train and other options in the illustrated embodiment. When one of the options of the trailer submenu 54 are selected, a predetermined message corresponding to the option selected is transmitted. Fault codes are also transmitted when roadside assistance messages are transmitted.

The third option of the message type menu 46 is the free text option. When the free text option is selected, free text may be entered using the selector 20. Free text may only be entered when the vehicle is stopped in the exemplary embodiment.

In the embodiment illustrated in FIGS. 3A, 3B and 4, the selector 20 includes an interface lever 56 or stalk that extends from a steering column 58 of the truck 12 (shown in FIG. 3B). One acceptable interface lever 56 is model number 3962199, produced by SMF. The interface lever 56 includes a toggle switch 60, an enter button 62, and an escape button 64. The illustrated toggle switch is a rocker type switch. In the exemplary embodiment, the lever 56 is also used to control movement of the windshield wipers and dispensing of windshield wiper fluid.

The toggle switch 60 allows the user to scroll up and down the menus of the display unit 18 to highlight a desired option. Once a desired option is highlighted, the enter button 62 on the lever 56 is pressed to select that option. When the option is selected, the function indicated by that option is performed or a submenu with additional choices that correspond to the selected option is entered. To return to the primary menu 38, the escape button 64 is pushed allowing the user to select from the options of the primary menu 38 by operating the toggle switch 60.

For example, the satellite communication option on the primary menu 38 can be highlighted by pressing the toggle switch 60 to scroll up and down the primary menu 38. Once the satellite communications option is highlighted, the enter button 62 is pressed to select the satellite communications option and the satellite communications menu 40 is entered. If a priority message has been received by the communications unit 10, the read message option of the satellite communications menu 40 can be selected using the toggle switch 60 and the enter button 62. Priority messages may be viewed regardless of the movement of the truck 12. If the truck 12 is moving, the driver may only respond to priority messages by selecting the predetermined responses in the response menu 44 by operating the toggle switch 60 and the enter button 62.

If the truck 12 is stopped, movement of the toggle switch 60 and pressing the enter button 62 allows the driver to enter the read message menu or the send message menu. When in the send message menu the drive can select one of the predetermined messages. Also, if the truck 12 is stopped, non-priority messages can be accessed and responded to through the read message menu by operating the toggle switch 60 and the enter button 62.

By using the toggle switch 60 and the enter button 62, the operator may also select the free text option of the message type menu 46. This option allows the user to input free text messages up to 80 characters long using the toggle switch 60 and the enter button 62. Once the free text option is selected, the user can scroll through a list of alpha-numeric characters by pressing the toggle switch 60. Once the desired character is highlighted by operating the toggle switch 60, the character is selected by pressing the enter button 62. This process is repeated until the desired message is entered. The driver may "type" up to 80 characters. The driver scrolls up and down to select the right letter. The driver hits enter to select a letter the driver hits enter again to move to the next line. The driver sends the message by pressing enter again.

Figure 1:
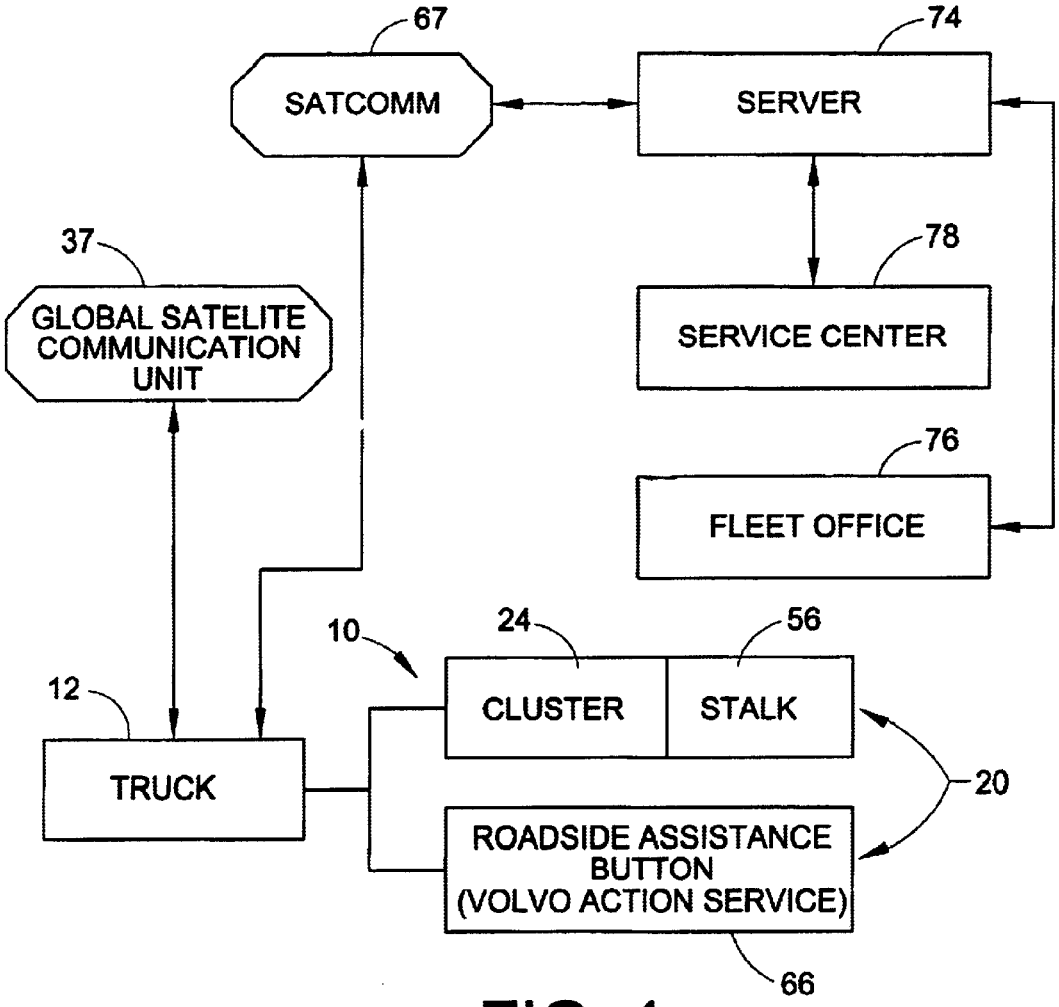
FIG. 1 is a schematic representation of communication via an integrated vehicle communication system.

Referring to FIGS. 1 and 2, once a desired message is selected using the lever 56, or the roadside assistance button 66, the message is sent to the satellite ECU 32. One acceptable satellite ECU is model no. 20457249, manufactured by Quake Global. Messages selected with the lever 56 are sent from the cluster 24 to the satellite ECU 32 via a datalink 68. One acceptable datalink is a J1587 datalink. When the roadside assistance button 66 is pressed, the roadside assistance message is transmitted to the satellite ECU 32 via an IO port. Once the satellite ECU 32 receives a message from the cluster 24 or the roadside assistance button 66, the satellite ECU 32 waits until it detects a satellite 67 that it can transmit the message to (FIG. 1). Once a satellite 67 is detected, the message is sent from the satellite ECU 32 though a multiplex box 70 through a CB antenna 72 to the satellite 67 in the exemplary embodiment (FIG. 2). The function of the multiplex box 70 is to filter out all the frequencies from the antenna 50 each component (radio, CB, cell phone) can get a clean signal with as little disturbance as possible. In an alternate embodiment, a radio antenna, rather than a CB antenna 72 may be used to transmit the message to the satellite.

In one embodiment, a CB antenna is routed to all of the components through a multiplex box except the radio. In this embodiment a second antenna is routed directly to the radio.

Referring to FIG. 1, to receive messages from the fleet office 76 or the service center 78, the message is sent from the fleet office 76 or service center 78 over a worldwide web server 74 to the satellite system. The satellite sends the message through the air down to the truck's CB antenna 72. The message received by the CB antenna 72 passes through the multiplex box 70 and is filtered to a frequency of 130 to 150 MHZ. The satellite electronic communications unit 32 identifies that a message has been received. The satellite electronic communications unit 32 puts the message in queue. The message is sent to the cluster 24 via the datalink 68. In the exemplary embodiment, the datalink 68 is a J1587 datalink.

After the message is received, one of two types of icons will appear on the display unit 18. The first icon indicates an important or priority message. The second type of icon indicates a normal or non-priority message. The important or priority message can be read while the truck 12 is moving and a very limited response may be selected and sent while the truck 12 is moving. For example, the user may select a "YES", "NO", or "RESPOND AT NEXT STOP" response to the priority message. The free text or predefined messages cannot be sent while the truck 12 is moving. To send a normal or non-priority message, the driver needs to stop to be able to read the message or respond to the message. When the truck 12 is stopped, there are no limitations to sending or reading the message. When the message icon appears in the cluster display 18 the driver uses the toggle switch 60 and button 62 on the lever 56 to select and read the message.

To safely and easily transmit and receive messages, the integrated communications system 10 of the present invention first monitors the truck engine to determine if the truck 12 is running. In the exemplary embodiment, the databus 34 is used to determine whether the truck 12 is running. Motion of the truck 12 is then monitored to determine whether or not the truck 12 is moving. The motion of the truck 12 is monitored by monitoring the GPS antenna 36 in one embodiment. In another embodiment, motion of the truck 12 is detected by monitoring the databus 34, which is operably coupled to a truck component that indicates whether or not the truck 12 is moving, for example, the truck transmission or the truck axle. Messages that are received from a sending party, such as the fleet office 76 or the service center 78, are stored by the satellite ECU 32. These messages are designated as high priority or low priority messages. The system prevents low priority messages from being displayed when the truck 12 is moving. The high priority messages may be displayed on the display unit 18 in the instrument panel 26, regardless of whether the truck 12 is moving. When the truck 12 is moving, a high priority response to the high priority message may be selected by operating the toggle switch 60 and the enter button 62 on the lever 56 that extends from the steering column 58. The predefined high priority response is transmitted to a receiving party, such as the service center 78 or the fleet office 76.

Low priority messages will only be displayed when the truck 12 is stopped. A low priority response to the low priority message may be selected by operating the toggle switch 60 and the enter button 62 on the lever 56 when the truck 12 is stopped. In addition, the user may send any of the predetermined messages or enter a free text message in response to the low priority message, as long as the vehicle is stopped. The message in response to the low priority message is then transmitted.

The cluster 24 stores predetermined messages for transmission by the driver to the receiving party. The cluster 24 prevents the predetermined messages from being displayed on the display unit 18 while the truck 12 is moving. The predetermined messages may be displayed on the display unit 18 when the truck 12 is stopped. The predetermined messages may be selected by operating the toggle switch 60 and the enter button 62 with the lever 56 when the truck 12 is stopped. The predetermined message is sent via satellite to the receiving party. In the exemplary embodiment, the satellite communicates the predetermined message or any other message to a world wide web server 74 which may be accessed by the service center 78 or the fleet office 76. Free text messages may also be entered by operating the toggle switch 60 and the enter button 62 on the lever 56.

Operation of Communication System 10

The illustrated communications system 10 provides satellite communications between driver and it's fleet. The system includes an ECU, a GPS antenna, wiring harness and dash switch. This system allows communications between Web based (customer) software and the vehicle.

Sending and Receiving Messages

The illustrated system 10 has the ability to send brief text messages to and from the vehicle, similar to an e-mail system. The graphic display 18 in the vehicle's instrument cluster is used for viewing and entering messages.

Referring to FIG. 3A, the controls for the graphic display are the 4 buttons in the stalk 58 on the right side of the steering system.

1. "Esc" (Escape) 64 is used to return to the previous menu and cancel a setting/operation.

2. "↵" or "SELECT" 62 confirms a highlighted selection of a menu or character.

3. "UP arrow" moves the cursor up and is used to setting numerical values.

4. "Down arrow" moves the cursor down and is used to setting numerical values.

Using the Graphic Display

In the exemplary embodiment, the satellite communications system 10 menu is the fist item shown in the graphic display (see FIG. 4). The up/down buttons on the stalk 56 are used to highlight it. Return 62 is pressed to select satellite communications. After selecting satellite communications, another screen will pop up, offering the choice to send or read messages 40.

Sending Messages (Web to Vehicle)

In the exemplary embodiment, the user (dispatcher) logs into communication system's web site and selects from a list of vehicles that is within the customer access rights. Once the vehicle is selected, the user can choose from a list of pre-defined messages or can manually enter a message to send to the vehicle.

Sending Messages from the Vehicle

In the exemplary embodiment, the driver of the vehicle can send messages from the vehicle to his fleet (web application). In the exemplary embodiment, messages can be sent when the vehicle is stopped, but not while it is moving. If a user attempts to send a message while the vehicle is moving an error message will display, and the message will not be sent.

Referring to FIG. 5, the driver can send 3 types of messages. These options are selectable from the graphic display at 46.

Receiving Messages (Web to Vehicle)

In the exemplary embodiment, messages are received at the vehicle from the fleet or (web application). When a message is received by the ECU, the driver is notified with an INFO lamp and a message in the instrument cluster's graphic display.

Free Text

Referring to FIG. 7, free text messages may be sent as follows:

From the blank screen with a cursor, use the up/down arrows to scroll through the numbers 0–9 and the alphabet to create your message, one character at a time.

For the first character, scroll up or down until you reach the letter/number desired, then press the "↵" button. Repeat for each character When finished with the message, press the "↵" button and hold for 3 seconds to send. If you make a mistake, press Esc to go back of the previous character. To cancel sending a typed messages, press Esc until the message is cleared rom the screen.

After Message is Sent

In the exemplary embodiment, after a message is sent, one of the following confirmations will appear on screen: "Sending Not Allowed," "Messages Sent," or "No Subscription." If "Sending Not Allowed" shows on screen, the message was not sent. The reason for this failure is most likely that the vehicle was in motion. "Message Sent" confirms message was sent by the ECU. "No Subscription" indicates messaging capabilities have been disabled by the web application. If "Operation Failed" appears on the screen during an attempt to send a message, this is either an indication of network congestion, or a system failure.

Incoming Message Notification

In the exemplary embodiment, messages are received at the vehicle from the fleet operator (web application). When a message is received by the system ECU, the driver will be notified with the INFO lamp and a message in the instrument cluster's graphic display. The message will appear one of the two following ways: "New Message in Volvo Link" and/or "Priority Message in Volvo Link."

Viewing Messages

In the exemplary embodiment, to view all stored messages, "satellite communications" then "Read Messages" are selected in the cluster's graphic display.

The messages will display, one at a time, with the most recent message shown first. Once the first message is shown, the driver can use the UP/DOWN buttons to scroll through the other messages. UP goes to the previous message. DOWN goes to the next message. The message buffer will hold 5 messages. If the buffer is full and the unit receives a new message, the oldest message in the queue will be deleted. While the vehicle is moving, the last message received is the only one that can be displayed. If the driver has authorization to see the message while driving, the message will be displayed. If not, he will see a message directing him to "Stop Vehicle to Read Message."

There are two types of messages: "Low and High priority messages." The default set up is that neither type of message can be read while driving. But the high priority messages can be read while driving—if this option is set in the system. This option is set by each individual fleet. In the exemplary embodiment, the default is that the priority message NOT be readable while driving, for safety reasons.

Quick Response to Incoming Messages

The system may be set up to give the driver the option of a quick response to the most recent message in the queue. The quick response can be sent while driving. The quick response uses pre-defined text: "Yes/OK," "No," or "Respond @ Next Stop."

Roadside Assistance

Breakdown or roadside assistance allows the driver to send breakdown messages along with the vehicle's Global Position System (GPS) location to a service group, which can then help the driver by sending a service vehicle to his location.

In one embodiment, a second selector is included for regulating roadside assistance. The second selector is a roadside assistance button 66. When the roadside assistance button 66 is pressed, a message indicating that the vehicle needs roadside assistance is selected and transmitted. The roadside assistance connects the truck to a service center, such as Volvo Action Service (VAS). When the roadside assistance button is pressed information is sent from the truck to the service center. In the exemplary embodiment, the service center can communicate with the driver until the service center has sent an end message. The roadside assistance button 66 makes it very easy for the user to request roadside assistance, eliminating the need to scroll through the menus of the display unit 18 to request roadside assistance. The user simply presses the roadside assistance button 66 to request roadside assistance.

Referring to FIG. 1, after the message from the roadside assistance button 66 or the display unit 18 of the cluster 24 is received by the satellite, the satellite sends the message to a worldwide web server 74 or desktop computer. The worldwide web server 74 or desktop computer routes the messages to the appropriate location. Messages from the display unit 18 of the cluster 24 are generally directed to the fleet office 76. Messages from the roadside assistance button 66 are generally delivered to a service center 78, which in the exemplary embodiment is Volvo Action Service.

A message is sent with the roadside assistance button 66 by pressing the roadside assistance button 66 continuously for 5 seconds. When the roadside assistance button is pressed, the integrated communications system 10 sends a roadside assistance message to the service center 78 and, in some cases, the fleet office 76. In the exemplary embodiment, the roadside assistance message is stored in the satellite ECU 32. When the operator then presses the roadside assistance button 66, the roadside assistance message is passed through the multiplex box 70 to the CB antenna. The message is transmitted over the CB antenna 72 or the radio antenna to a satellite.

The service center 78 is contacted with the message that roadside assistance is necessary. If the driver had accidentally or mistakenly pressed the roadside assistance button 66, the driver could press the button again to cancel the call provided the button is pressed a second time within 30 seconds of the initial signal.

After the service center 78 receives a roadside assistance signal, the service center 78 sends a message back to the truck indicating that the roadside assistance signal has been received (FIG. 10).

The service center 78 immediately begins to initiate steps to diagnosis the vehicle break down by sending a satellite signal to the vehicle to request fault codes from the various on-board electric control units. In one embodiment, the fault codes are transmitted when the roadside assistance button is pressed, so the Volvo Action Service operator does not need to ask for the fault codes. The location of the truck is also sent to VAS when the roadside assistance button is pressed. In one embodiment, the GPS position of the truck 12 is also transmitted back to the service center 78. While the service center 78 is in communication with the truck 12 after the roadside assistance button 66 has been pressed, the fleet office 76 is prevented from communicating with the truck 12. The fault codes are sent through the satellite communications unit of a vehicle to a satellite. The fault code signals transmitted to the satellite are communicated by the worldwide web server 74 to the service center 78. The service center 78 analyzes the fault codes to determine the cause of the break down. Once the fault codes are received and diagnosed, a message is sent to the truck 12 with the recommended plan of action.

In one embodiment, the fleet office 76, in addition to the service center 78, is contacted when the roadside assistance button 66 is pressed. Once the cause of the break down is determined, an end message is sent to the truck 12 and functionality of the cluster 24 is closed down if the truck 12 does not subscribe to that service. In the exemplary embodiment, separate subscriptions are available for the messaging service and the roadside assistance service. As subscription to the messaging service allows the operator to send and receive messages with the selector 20. A subscription to the roadside assistance allows the operator to request roadside assistance by pressing the roadside assistance button.

Referring to FIG. 1, in one embodiment, when there is no subscription to the roadside assistance service, a breakdown message, selected from the cluster, such as flat tire, is sent to the fleet. The breakdown message is sent to the communications channel 167 and routed via the server. The fleet can see the message and respond back to the truck.

Referring to FIG. 1, when the truck subscribes to the roadside assistance service, but does not subscribe to the messaging service, the service button 66 is pressed for 5 seconds after which a message is sent to service. There is 30 seconds regret time. If the driver pushes the button again within 30 seconds the message with support information in the cluster will be canceled. The message is sent to service and the Communications Unit will open up with full functionality in the cluster and inform the driver that the message has been sent. Breakdown messages are sent to the service center including fault codes, time stamp, and GPS position. Breakdown messages are routed via the www server. The service center will receive the message and respond and acknowledge the message. Communication between the service center and the driver has now started. When the breakdown is solved, an end message is sent to the truck and will close down the functionality in the truck, to no subscription mode.

Referring to FIG. 1, when the truck has a subscription to the roadside assistance service and the message service, the service button is pressed at 5 seconds, after that a message is sent to service. There is 30 seconds regret time, if the driver pushes the button again this will cancel the message with support information in the cluster. The message is sent to service, and the Communications Unit will inform the driver that the message has been sent. Breakdown messages are sent to the service center with fault codes, time stamp, and GPS position. Breakdown messages are routed via the www server. The service center will receive the message and the fleet can now see the message and respond to acknowledge the message. All communication to the truck from fleet is temporarily blocked.

Communication between the service center and the driver has now started. The fleet can see the communication between the two. When the breakdown is solved, an end message is sent to the truck and will open up for communication between the fleet and the truck.

Activation of Roadside Assistance via Service Switch

The driver can activate the breakdown assistance by pressing and holding the service switch located on the dash for 5 seconds. Once the service switch has been pressed, the driver has 30 seconds to cancel by pressing the switch again. The switch LED will blink during this 30 seconds. If the driver does not cancel it, the message will be sent to service. The switch LED will stay on and remain solid, indicating that the message has been sent. The transmission to service will include the specific breakdown message along with the vehicle's GPS location.

Once the switch has been pressed, any text message the driver attempts to send, including text messages, will be transmitted to the service center.

In the exemplary embodiment, the service switch will not function if the vehicle is moving (it is for breakdown assistance only).

In the exemplary embodiment, the service subscription is an option. If the vehicle does not have an active subscription, the switch will not function when pressed, and the LED will not illuminate.

Activation via the Instrument Cluster

The driver can select from a list of predefined road side assistance messages within the cluster's menu. There are approximately 10 selections that are related to common tractor and trailer failures. These messages will go directly to the customer's web site. The customer will handle the breakdown from that point.

Vehicle Log Data

Total miles, total idle fuel used, total engine idle hours, total engine hours, vehicle location (GPS). This data can be requested via the Web or can be set up in the ECU to be sent at predetermined time intervals via the Web. Data is recorded using the J1587 data link on the vehicle.

Although the present invention has been described with a degree of particularity, it is the intent that the invention include all modifications and alterations falling within the spirit or scope of the appended claims.

We claim:

1. A communications system for use in a truck, comprising:

a) memory for storing messages for transmission by a driver to a receiving party;

b) a sensor for sensing movement and/or location of such truck;

c) a display unit coupled to said memory and said sensor for displaying stored text messages only when said sensor senses that said truck is stopped;

d) a selector for selecting at least one of said stored messages for transmission to the receiving party; and e) a transmitter for transmitting one or more selected messages.

2. The communications system of claim 1 wherein said display unit is integral to a vehicle instrument panel.

3. The communications system of claim 1 wherein said selector includes a lever that extends from a steering column of said vehicle, a toggle switch for highlighting options and a button for selecting a highlighted option.

4. The communications system of claim 1 wherein said transmitter is included in a satellite communications unit, said satellite communications unit including a receiver for receiving messages from a sending party.

5. The communications system of claim 1 wherein said selector comprises a toggle switch on a lever that is actuated to hightlight a subset of said stored messages on said display unit that can be selected by a driver by pressing a button on said lever.

6. The communications system of claim 1 wherein said selector is also actuated to display a subset of said vehicle operating parameters on said display unit.

7. The communications system of claim 1 wherein said transmitter transmits signals to a satellite.

8. The communications system of claim 1 wherein said transmitter is a satellite electronic communications unit.

9. The communications system of claim 8 further comprising a citizens' band antenna coupled to said satellite electronic communications unit.

10. The communications system of claim 1 wherein said sensor is a global positioning system.

11. The communications system of claim 1 wherein said sensor is operably connected to a vehicle engine to determine whether said truck is stopped and is operably connected to said display.

12. The communications system of claim 1 wherein said sensor is operably connected to a vehicle transmission to determine whether said truck is stopped and is operably connected to said display.

13. The communications system of claim 1 wherein said selector is supported by a steering column of said vehicle.

14. A communications system for use in a heavy duty truck by a driver to safely send messages to a receiving party and to receive messages from a sending party comprising:

a) an instrument panel for displaying the status of a plurality of vehicle operating parameters;

b) a memory for storing a plurality of messages, wherein stored messages are selectively displayed on said text display unit, said stored messages include incoming messages from such sending party and predetermined messages to be sent to such receiving party;

c) a global positioning sensor for sensing movement of said truck;

d) a text display unit integrated into said instrument panel and coupled to said memory and to said global positioning sensor, said text display unit displays said predetermined messages only when said truck is stopped, said text display unit displays priority incoming messages regardless of movement of said truck, said text display unit displays non-priority incoming messages only when said truck is stopped; and e) an interface lever including a toggle switch and a return button extending from a steering column of said truck, movement of said switch allows such driver to highlight one of said predetermined messages when said truck is stopped, pressing said button selects a highlighted message, movement of said switch allows such driver to selectively view said priority incoming messages regardless of movement of such truck, movement of said switch allows such driver to highlight a response to said priority incoming messages regardless of movement of such truck, pressing said button selects a highlighted response, movement of said switch allows such driver to view said non-priority messages only when said truck is stopped, movement of said switch allows such driver to scroll through alphanumeric characters, pressing said button allows said user to select a highlighted character to input free text messages only when such truck is stopped.

15. The communications system of claim 14 further comprising a satellite electronic communications unit coupled to said display for transmitting and receiving messages.

16. The communications system of claim 15 further comprising a citizens' band antenna coupled to said satellite electronic communications unit for transmitting and receiving messages to a satellite and from a satellite.

17. A method of sending free text messages from inside a cab of a heavy duty truck, comprising:

a) monitoring a speed of said truck;

b) preventing a driver from entering free text messages when said truck is moving;

c) allowing entry of free text messages by operating a toggle switch on a lever that extends from a steering column of said truck only when said truck is stopped;

d) displaying said free text messages on a display unit that is integral to a vehicle instrument panel only when said vehicle is stopped; and e) transmitting said free text message to a receiving party.

18. The method of claim 17 wherein said free text message is transmitted via a satellite.

19. The method of claim 17 wherein said free text message is transmitted via terrestrial towers.

20. The method of claim 17 wherein said free text message is transmitted via a cellular phone.

21. A method of controlling communication from inside a cab of a truck, comprising:

a) monitoring a speed of said truck;

b) storing predetermined text messages for transmission by a driver to a receiving party;

c) preventing said predetermined messages from being displayed when said truck is moving;

d) displaying said text messages on a display unit that is integral to a vehicle instrument panel only when said vehicle is stopped;

e) allowing selection of one of said text messages by operating a toggle switch on a lever that extends from a steering column of said truck only when said truck is stopped; and f) transmitting said text message to said receiving party.

22. The method of claim 21 wherein said text message is transmitted via a satellite.

23. The method of claim 21 wherein said free text message is transmitted via terrestrial towers.

24. The method of claim 21 wherein said free text message is transmitted via a cellular phone.

25. A method of communicating from inside a cab of a heavy duty truck, comprising:

a) monitoring a speed of said truck;

b) storing received messages that are received from a sending party;

c) preventing said received messages from being displayed when said truck is moving;

d) allowing said received messages to be displayed on a display unit that is integral to a vehicle instrument panel only when said vehicle is stopped;

e) allowing selection of a predetermined response by operating a toggle switch on a lever that extends from a steering column of said truck only when said truck is stopped; and f) transmitting said response to a receiving party.

26. The method of claim 25 wherein said free text message is transmitted via a satellite.

27. The method of claim 25 wherein said free text message is transmitted via terrestrial towers.

28. The method of claim 25 wherein said free text message is transmitted via a cellular phone.

29. A method of communicating from inside a cab of a truck, comprising:

a) monitoring the truck engine to determine if the truck is running;

b) monitoring motion of said truck with a global positioning system;

c) storing received messages that are received from a sending party, said received messages including low priority messages and high priority messages;

d) preventing said low priority messages from being displayed when said truck is moving;

e) displaying high priority messages on a display unit that is integral to a truck instrument panel regardless of whether said truck is moving;

f) selecting a predefined high priority response to said high priority messages;

g) transmitting said predefined high priority response to said high priority messages to a receiving party;

h) displaying low priority messages on said display when said truck is stopped;

i) selecting a low priority response to said low priority messages by operating said lever when said truck is stopped;

j) transmitting said low priority response;

k) storing predetermined text messages for transmission by a driver to a receiving party;

l) preventing said predetermined messages from being displayed on said display when said truck is moving;

m) displaying said predetermined messages on said display unit when said vehicle is stopped;

n) selecting one of said predetermined messages with said toggle switch when said truck is stopped; and o) transmitting said predetermined message to a receiving party via a satellite to receiving party.

30. The method of claim 29 further comprising entering a free text message by scrolling through alpha-numeric characters by pressing said toggle switch and selecting characters by pressing an enter button and transmitting said free text message.

31. A communications system for use in a truck to contact a service center, comprising:

a) memory for storing a roadside assistance message for transmission by a driver to a said service center;

b) a satellite communications unit in communication with the memory;

c) a world wide web server in communication with the satellite communications unit and the service center; and, d) a roadside assistance button coupled to said satellite communications unit, wherein pushing said button causes said satellite communications unit to send a roadside assistance signal to a satellite that sends the signal to said server that communicates the signal to the service center.

32. The communications system of claim 31 further comprising a global positioning system that locates said truck and transmits the coordinates of said truck to said service center.

33. A method of communicating from inside the cab of a truck, comprising:

a) storing a roadside assistance message for transmission to a service center;

b) pressing a roadside assistance button;

c) communicating said roadside assistance message to a satellite communications unit;

d) transmitting said roadside assistance message to a satellite;

e) transmitting said roadside assistance message to a worldwide web server; and, f) accessing said roadside assistance message at said service center.

34. The method of claim 33, further comprising locating the position of the truck with a global positioning system and providing the position of the truck to the service center.

35. The method of claim 33, further comprising transmitting the roadside assistance signal to a truck company dispatcher.

36. A communications system for use in a truck, comprising:

a) a display unit for displaying incoming and outgoing text messages when the vehicle is stopped;

b) a selector coupled to said display unit for selectively viewing incoming text messages and sending outgoing messages;

c) a memory coupled to said display;

d) a datalink coupled to said display;

e) an electronic communications unit coupled to said display;

f) a GPS antenna coupled to said electronic communications unit; and, g) at least one of a CB antenna and a radio antenna coupled to said electronic communications unit.

37. The communications system of claim 36, wherein said at least one of said CB antenna and said radio antenna are coupled to said electronic communications unit by a multiplex box.

38. The system of claim 36 wherein said CB antenna is coupled to said electronic communications unit by a multiplex box and a radio is connected directly to a separate radio antenna.

39. The communications system of claim 36, wherein said data link monitors components of such truck.

40. A method of communicating from a cab of a truck, comprising:

a) sending a message from the truck to a service center via a world wide web server indicating that a breakdown has occurred;

b) preventing messages from sources other than said service center via the world wide web to said truck;

c) analyzing said message sent from said truck to said service center;

d) sending a message from said service center to said truck;

e) enabling messages from sources other than said service center to send messages via the world wide web to said truck.

41. The method of claim 40, wherein said message from said truck to said service center includes fault codes of said truck.

42. The method of claim 40, wherein said message from said truck to said service center includes a location of said truck.

43. The method of claim 40, wherein said message from said truck to said service center includes a breakdown message.

44. A communications system for use in a heavy duty truck by a driver to safely send messages to a receiving party and to receive messages from a sending party comprising:

a) an instrument panel for displaying the status of a plurality of vehicle operating parameters;

b) a memory for storing a plurality of messages, wherein stored messages are selectively displayed on said text display unit, said stored messages include incoming messages from such sending party and predetermined messages to be sent to such receiving party;

c) a global positioning sensor for sensing movement of said truck;

d) a text display unit integrated into said instrument panel and coupled to said memory and to said global positioning sensor, said text display unit displays said predetermined messages only when said truck is stopped, said text display unit displays priority incoming messages regardless of movement of said truck, said text display unit displays non-priority incoming messages only when said truck is stopped; and e) a selector configured to allow such driver to highlight one of said predetermined messages when said truck is stopped, select a highlighted message, selectively view said priority incoming messages regardless of movement of such truck, highlight a response to said priority incoming messages regardless of movement of such truck, select a highlighted response, view said non-priority messages only when said truck is stopped, scroll through alpha-numeric characters, and select a highlighted character to input free text messages only when such truck is stopped.

45. A method of sending free text messages from inside a cab of a heavy duty truck, comprising:

a) monitoring a speed of said truck;

b) preventing a driver from entering free text messages when said truck is moving;

c) entering free text messages by operating a selector;

d) displaying said free text messages on a display unit that is integral to a vehicle instrument panel when said vehicle is stopped; and e) transmitting said free text message to a receiving party.

46. A method of communicating from inside a cab of a truck, comprising:

a) monitoring a speed of said truck;

b) storing predetermined text messages for transmission by a driver to a receiving party;

c) preventing said predetermined messages from being displayed when said truck is moving;

d) displaying said text messages on a display unit that is integral to a vehicle instrument panel when said vehicle is stopped;

e) selecting one of said text messages only when said truck is stopped; and f) transmitting said text message to said receiving party.

47. A method of communicating from inside a cab of a heavy duty truck, comprising:

a) monitoring a speed of said truck;

b) storing received messages that are received from a sending party;

c) preventing said received messages from being displayed when said truck is moving;

d) displaying said received messages on a display unit that is integral to a vehicle instrument panel when said vehicle is stopped;

e) selecting a predetermined response by operating a selector when said truck is stopped; and, f) transmitting said response to a receiving party.

48. A communications system for use in a truck, comprising:

a) memory for storing messages for transmission by a driver to a receiving party;

b) a sensor for sensing movement of such truck;

c) a display unit integral to a truck instrument panel coupled to said memory and said sensor for displaying stored messages;

d) a selector for selecting at least one of said stored messages for transmission to the receiving party; and e) a transmitter for transmitting one or more selected messages.

49. A method of communicating from inside a cab of a truck, comprising:

a) monitoring a speed of said truck;

b) storing predetermined text messages for transmission by a driver to a receiving party;

c) preventing said predetermined messages from being displayed when said truck is moving at a speed above a predetermined speed;

d) displaying said text messages on a display unit that is integral to a vehicle instrument panel when said vehicle is moving at a speed below said predetermined speed;

e) selecting one of said text messages only when said truck is moving at a speed below said predetermined speed; and f) transmitting said text message to said receiving party.

50. A communications system for use in a truck, comprising:

a) memory for storing messages for transmission by a driver to a receiving party;

b) a sensor for sensing movement of such truck;

c) a display unit integral to a truck instrument panel coupled to said memory and said sensor for displaying stored messages when said truck is moving at a speed below a predetermined speed;

d) a selector for selecting at least one of said stored messages for transmission to the receiving party; and e) a transmitter for transmitting one or more selected messages.

51. An interface lever for use in a communications system installed in a heavy duty truck and used by a driver to safely send messages to a receiving party and to receive either priority and non-priority incoming messages from a sending party, said lever comprising:

a) a toggle switch and a return button extending from a steering column of said truck;

b) wherein movement of said switch allows such driver to highlight one of said predetermined messages when said truck is stopped, pressing said button selects a highlighted message, movement of said switch allows such driver to selectively view said priority incoming messages regardless of movement of such truck, movement of said switch allows such driver to highlight a response to said priority incoming messages regardless of movement of such truck, and pressing said button selects a highlighted response;

c) wherein movement of said switch allows such driver to view said non-priority incoming messages only when said truck is stopped, movement of said switch allows such driver to scroll through alpha-numeric characters, and pressing said button allows said user to select a highlighted character to input free text messages only when such truck is stopped.

* * * * *